US008342485B2

(12) United States Patent
McGinness et al.

(10) Patent No.: US 8,342,485 B2
(45) Date of Patent: Jan. 1, 2013

(54) COMPRESSION POST MOUNT

(75) Inventors: William G. McGinness, Pinson, AL (US); Randall Heath, Pinson, AL (US); Maurice Coen, Orange Park, FL (US)

(73) Assignee: Homeland Vinyl Products, Inc., Pinson, AL (US)

( * ) Notice: Subject to any disclaimer, the term of this patent is extended or adjusted under 35 U.S.C. 154(b) by 1026 days.

(21) Appl. No.: 11/668,219

(22) Filed: Jan. 29, 2007

(65) Prior Publication Data

US 2008/0179579 A1 Jul. 31, 2008

(51) Int. Cl.
*E04H 17/00* (2006.01)

(52) U.S. Cl. ..... 256/65.14; 256/DIG. 5

(58) Field of Classification Search ..... 256/65.14, 256/DIG. 5

See application file for complete search history.

(56) References Cited

U.S. PATENT DOCUMENTS

| | | | | | |
|---|---|---|---|---|---|
| 1,135,817 | A * | 4/1915 | Klein et al. | 256/19 |
| 1,746,672 | A * | 2/1930 | Nylund et al. | 52/223.5 |
| 3,406,946 | A * | 10/1968 | Saultz | 256/65.14 |
| 3,888,282 | A * | 6/1975 | Liddall | 52/126.5 |
| 4,462,573 | A * | 7/1984 | Melfi et al. | 256/65.14 |
| 4,809,955 | A * | 3/1989 | Veilleux | 256/65.14 |
| 4,939,877 | A * | 7/1990 | Claffey | 52/155 |
| 5,303,900 | A * | 4/1994 | Zulick et al. | 256/65.05 |
| 5,359,827 | A * | 11/1994 | Gehman | 52/698 |
| 5,765,333 | A * | 6/1998 | Cunningham | 52/481.1 |
| 6,141,928 | A * | 11/2000 | Platt | 52/296 |
| 6,467,756 | B1 * | 10/2002 | Elsasser | 256/65.14 |
| 6,874,766 | B2 | 4/2005 | Curatolo | |
| 7,048,259 | B2 | 5/2006 | Quaintance | |
| 7,188,457 | B1 * | 3/2007 | Halama | 256/65.14 |
| 7,216,855 | B2 | 5/2007 | Platt | |
| 2003/0136068 | A1 * | 7/2003 | Forbis et al. | 52/296 |
| 2005/0017232 | A1 | 1/2005 | Chen | |

* cited by examiner

*Primary Examiner* — Victor MacArthur
(74) *Attorney, Agent, or Firm* — Smith, Gambrell & Russell

(57) ABSTRACT

A fence post assembly for mounting to a substructure with a single point of attachment. The post assembly has an outer sleeve surrounding a support member and an attachment rod extending through the support member. The post assembly is mounted to the substructure by securing one end of the attachment rod in the substructure and securing the support member between a compression plate and the substructure by tensioning the upper end of the attachment rod. Attachment points for securing additional fence components to the post are provided by inserting an adapter into a receiving channel defined along a longitudinal length of the support member.

9 Claims, 3 Drawing Sheets

Fig. 1
PRIOR ART
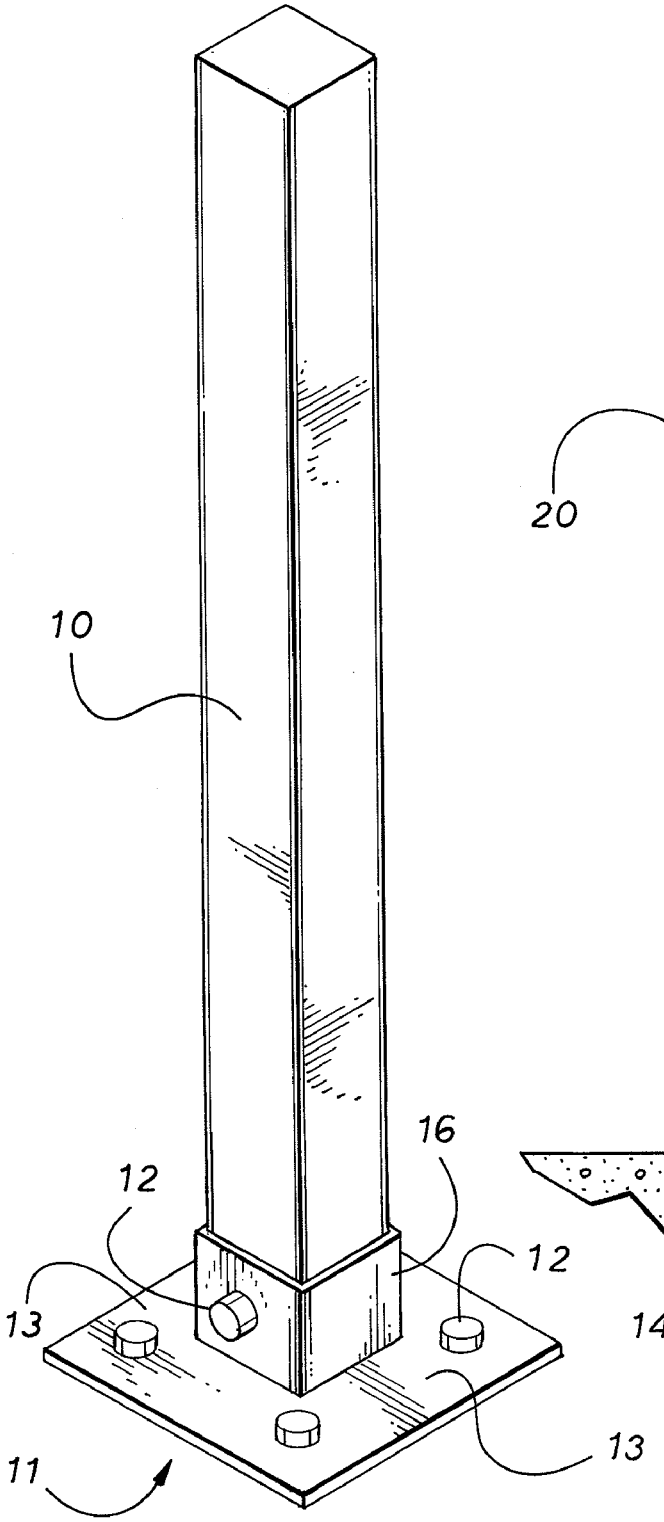
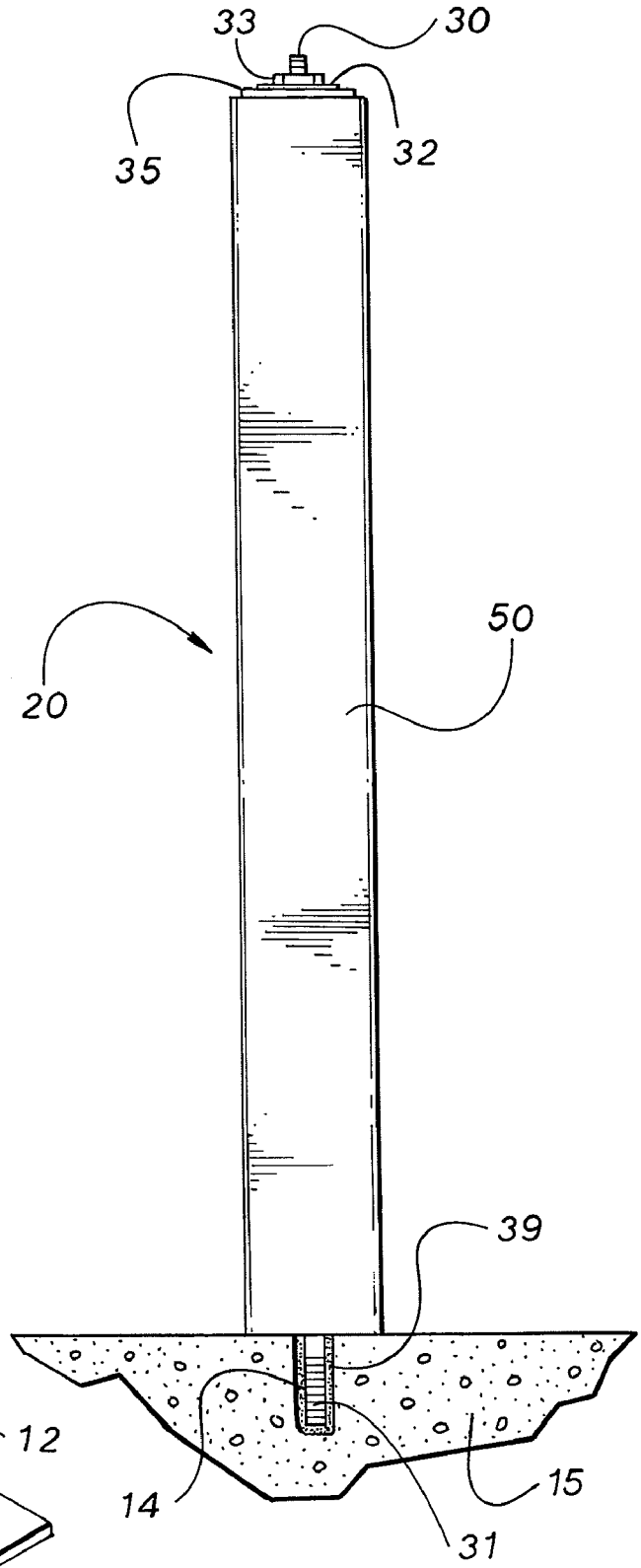
Fig. 2

COMPRESSION POST MOUNT

FIELD OF THE INVENTION

The present invention relates generally to the field of fences and guard rails. More particularly, the invention relates to support posts for fences and guard rails. With even greater particularity, the invention relates to a method of assembling and components for mounting a support post to a structure without external bracing.

BACKGROUND OF THE INVENTION

In the art of fences numerous materials and methods have been employed to construct and design fences for various purposes such as containment of livestock, pets, people and the like or for the exclusion of the same. In other instances, fences may be employed to add a decorative or aesthetic flourish to structures and landscapes.

More recently, vinyl, plastics and similar such materials have been found to be advantageous for fencing applications. They provide a convenient material due to their ease of fabrication, light weight, relative cost, and their ability to maintain an attractive appearance, particularly for exterior fencing, where weather may deteriorate the finish of wood or paints applied thereto.

A continuing problem with vinyl fence materials is finding a suitable means for mounting the support posts, particularly where there is a need to mount the post to an underlying concrete or masonry surface, such as a walkway, driveway, or patio. Similar difficulties are encountered when the post is mounted to a patio deck or similar structures.

Presently in the art, vinyl clad support posts are mounted to concrete and wooden substructures by an unsightly and bulky base mounting bracket. These mounting brackets typically have a sleeve portion that receives and surrounds the outer periphery of the lower end of the support post. These mounting brackets will typically have a base plate that extends outwardly beyond the periphery of the sleeve portion or they may include one or more flanges extending outwardly from the base of the sleeve portion. The base plates and flanges have a plurality of holes through which fasteners, such as a bolts, pins or screws, are received to secure the support bracket to the underlying structure.

In addition to their unsightly appearance, the typical mounting bracket presents an obvious disadvantage in that a hole must be drilled to receive each of the fasteners. Other more serious disadvantages are presented by the typical mounting bracket, because the base plate or flanges are oversized with respect to the post requiring the post to be mounted offset from the edge of the underlying substructure.

This deficiency is particularly troubling when it is desirable to mount a post near the periphery of a concrete slab or support pylon. If the holes required to receive the fasteners are drilled too closely to the edge of the concrete, the concrete is susceptible to fracture or spalling, either during installation of the fasteners or in subsequent use when lateral forces may be applied to the post or the containment system utilizing the posts for support. In this event, the costs of repairing the concrete can be substantial and the hazards presented by the post's failure can be catastrophic.

Similar problems exist with respect to the support post itself. The structure of many vinyl clad support posts also presents an issue regarding the points to which other fence members may be attached to the post. They may be limited both as to the vertical and lateral displacement at which fasteners may be securely attached due to the absence of an underlying metal support, as would be encountered with channeled or I-beam support members. Although tubular metal support members may be employed, a savings in material costs may not be realized.

BRIEF SUMMARY OF THE INVENTION

The present invention solves many of the aforementioned problems with existing vinyl clad fence support posts and their mounting. The post assembly of the present invention comprises an attachment rod, an elongate support member and a sleeve. The attachment rod is secured to the substructure and support member and outer sleeve are secured to the attachment rod. The support member comprises a support column having an inner bore defined through a longitudinal length of the column. The attachment rod is received within the bore of the support column. A plurality of arms extending radially outward from the support column such that the ends of the arms engage an inner wall of said sleeve.

The support member of the post assembly also provides an attachment point on a lateral face of the post, to which additional fence components, such as a rail or a gate, may be securely attached to the post. The attachment point comprises an adapter, preferably a plate, that is pressed or driven into a receiving channel defined along a longitudinal length of said support member. The receiving channel formed by flanges extending towards one another from the opposed surfaces of at least two adjacent arms.

The post assembly of the present invention provides superior structural strength while providing an attachment means that reduces concrete spalling or cracking, and offers the additional advantage of reducing drilling into the subsurface to a single point.

BRIEF DESCRIPTION OF THE SEVERAL VIEWS OF THE DRAWINGS

FIG. 1 depicts a mounting bracket typical in the prior art.

FIG. 2 depicts a side elevation view of a fence post according to the present invention.

DETAILED DESCRIPTION OF THE INVENTION

Figure 3:
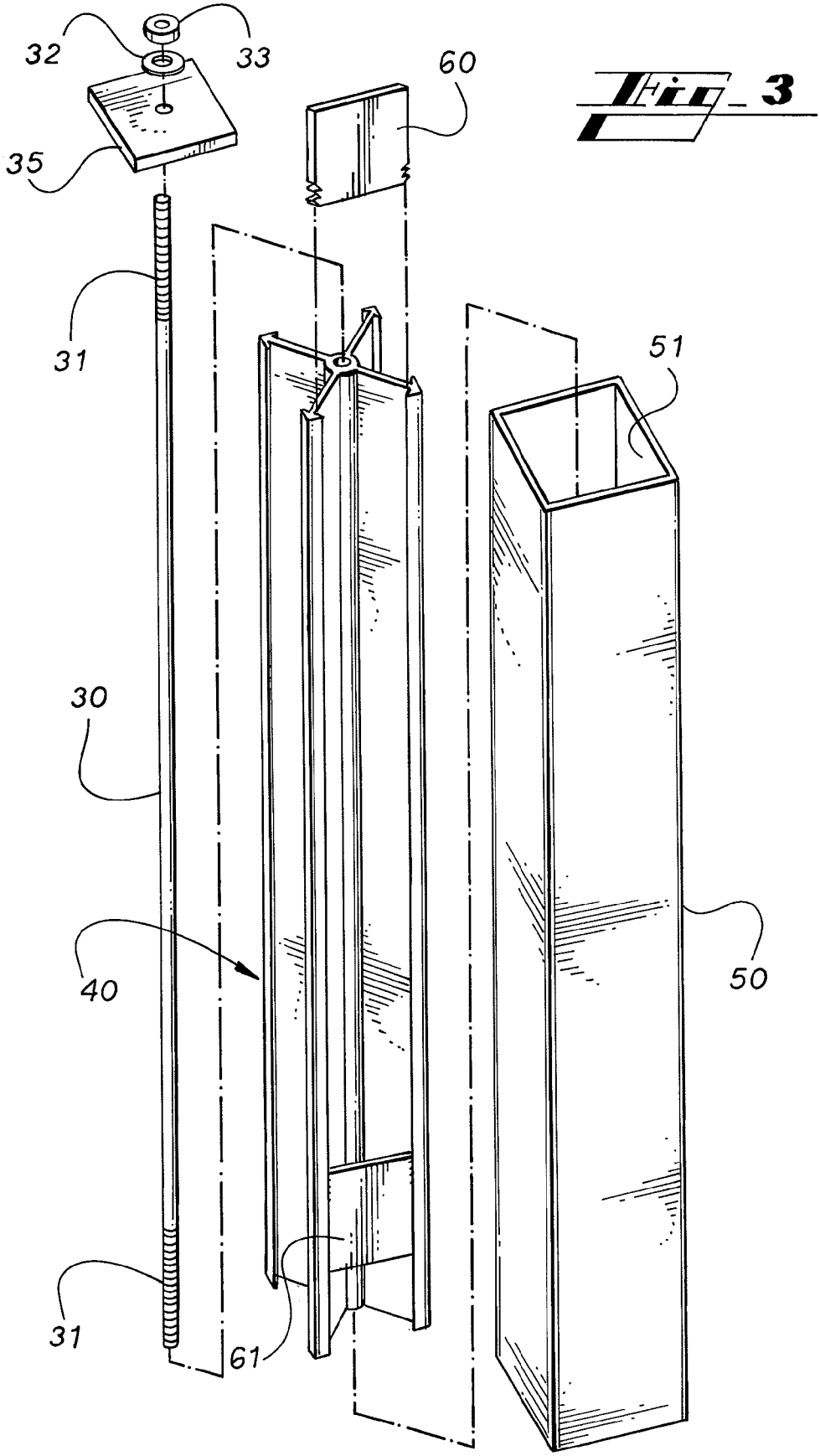
FIG. 3 depicts an exploded perspective view of a fence post according to the present invention.

FIG. 1 depicts a fence post 10 mounted by a typical mounting bracket 11 found in the prior art. As may be seen the post mount in the prior art requires a plurality of fasteners 12 and the base plate 13 exceeds the outer periphery of the post 10. By comparison with the post support 20 of the present invention depicted in FIGS. 2 and 3, the unsightly base bracket 11 and the requirement to drill a plurality of holes in the underlying substructure is eliminated. The post assembly 20 contemplated by the present invention includes an attachment rod 30, an internal support member 40, a sleeve 50, and an optional mounting adapter plate 60.

As seen in reference to FIG. 2, a single hole 14 is all that is required to mount the post assembly 20 in the underlying substructure 15. As depicted in FIG. 2, the substructure 15 is concrete. The single hole 14 is drilled to a suitable depth, preferably to a depth of at least 4 inches. For a one-half inch attachment rod we have found that a ⅝" hole 14 provides favorable results. During our testing we determined that attachment rod 30 is preferably secured within hole 14 by suitable adhesives 39. Adhesives specified by State and Federal Departments of Transportation for securing re-bar, rods, and bridge anchors into concrete worked well for our purposes. Attachment rod 30 should be supported in the desired vertical orientation while the adhesives cures.

Alternatively, an anchor may be inserted into the hole and threaded ends 31 of attachment rod 30 may be threadingly received by the anchor. While conventional concrete anchors may be utilized, we have found that they are susceptible to spalling and do not achieve results as favorable as those we achieved with adhesives.

If the underlying substructure 15 is a wooden plank, such as may be found on a deck or similar structure, attachment rod 30 may be secured to the substructure 15 by a suitable fastener such as washer 32 and nut 33 attached to the threads 31 at the end of support rod 30. We have found that adding a cross braced 2"×6" plank section or similar bracing material beneath the attachment point and extending attachment rod 30 through bracing material is desirable.

Support member 40 may be formed of a metallic, composite, or other approved construction material, and is preferably made of aluminum. Support member 40 has an inner bore 41, defined by an inner support column 42, with inner bore 41 dimensioned to receive attachment rod 30 therein. A plurality of arms 43 extend radially outward from support column 42. Arms 43 should extend so that the ends 44 of the arms 43 engage an inner wall or walls 51 of the sleeve 50, preferably with an interference fit to partially secure sleeve 50 on support member 40.

Figure 7:
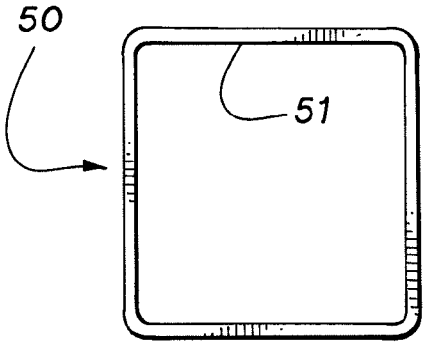
FIG. 7 depicts an outer sleeve for the fence post.

As may be seen inn reference to FIGS. 2, 3, and 7, sleeve 50 is a tubular construction having an inner wall 51 dimensioned such that support member 40 may be received within the sleeve 50. Sleeve 50 may be formed from any suitable material, preferably comprised of vinyl, plastic or similar material as these readily lend themselves to extrusion. The outer surface 52 of sleeve 50 is depicted as a flat surface, but may be extruded with any desired surface ornamentation.

Figure 8:
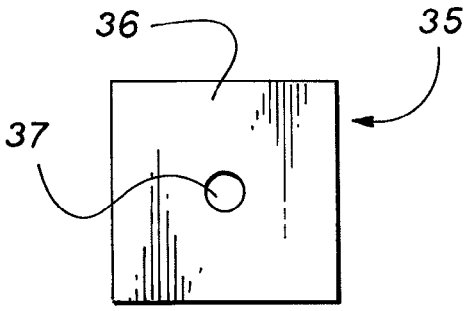
FIG. 8 depicts a plan view of a compression plate.

As may be seen in reference to FIGS. 2 and 3, post 20 is assembled by placing support member 40 over attachment rod 30, with sleeve 50 being placed over support member 40. A compression plate 35 having a surface area 36 generally comparable to that of the cross sectional area of support member 40, such as that depicted in FIG. 8, is placed over a threaded end 31 of attachment rod 30 through bore 37 and secured by fasteners 33 such as a conventional washer and nut. When attaching the post 10 to concrete and similarly strong substructure 15, we have found a single compression plate 35 placed over the top of the support member 40 is all that is necessary. However, where the substructure 15 is comprised of relatively soft material, such as wood or plastic, it is preferable to insert a second compression plate 35 between the lower end of support member 40 and the substructure 15, so as to more evenly distribute the forces over a wider surface area.

We have found that the post strength achieved with the tension applied to attachment rod 30 acting through compression plate 35 and support member 40 far exceeds that which is obtained through conventional bracket attachment.

In conducting tests according to International Building Code Standard 1607.7, we mounted attachment rod 30 to a test stand utilizing a ½" diameter; 46" long low carbon galvanized "All Tread" rod. The rod 30 was secured beneath the test stand with a ½" galvanized flat washer 32; a ½" galvanized lock washer 32 and a ½" galvanized threaded nut 33. The support member 40 was placed over the treaded rod and a ⅛" thick 3"×3" galvanized compression plate 35 was placed on top of the support member 40 over the attachment rod 30. The support member 40 was secured by placing another ½" galvanized flat washer 32; ½" galvanized lock nut 33, and ½" galvanized nut 33. A 6" box wrench was used to tension attachment rod 30 and place the support member 40 under compression. A 44" PVC sleeve 50 was sleeved over the support member 40.

At 42" elevation on post assembly 20, a strap was secured by tension utilizing a ratcheted come a long and a calibrated load cell. With a concentrated load of 202# held for 2 minutes the deflection was measured at 1". The allowable deflection of the IBC section 1607.7.1.1 is 2.75" for a post with an 8' rail span. The concentrated load was increased to 517# until failure; with the post holding at 498#. The point of failure was the crushing of the lower edge of support member 40.

The superior results produced by our post assembly 10 are due in part to the support member 40 being pulled against the substructure, producing a vertical attachment force that is not provided by conventional brackets.

The post 10 as so far described lend themselves to providing suitable structure for applications along a walkway or other areas where a chain or cable may be suspended between adjacent posts 10. To achieve broader range of application, it is necessary that the post 10 provide suitable attachment points 61 to accept other fence components such as a rail or a gate assembly.

Figure 4:
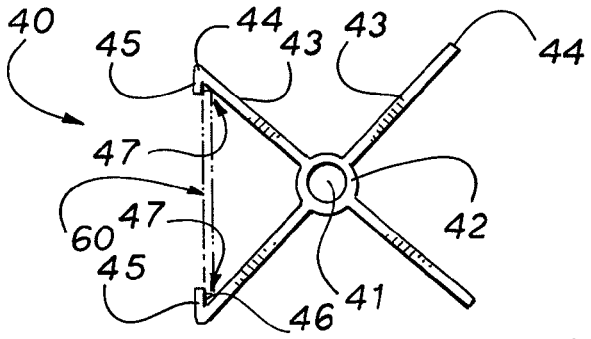
FIG. 4 depicts an end view of a post support member.

In a first embodiment depicted in FIG. 4, of a post that provides an attachment point 61 a pair of flanges 45 extend from the ends 44 of at least two adjacent arms 43. Flanges 45 are disposed such that the pair of flanges 45 point generally towards one another and define an apex 46 at the junction between the flange 45 and the arm 43. The flanges 45 would extend along the longitudinal length of the support member 40. The adjacent apexes 46 define a receiving channel 47 in to which an adapter 60 is inserted such that opposed lateral edges 62 of the adapter 60 have an interference fit within receiving channel 47 between the respective apexes 46. Adapter 60 is pressed or driven into receiving channel 47 to the desired height for the attachment point 61, as shown in FIG. 3, which provides a suitable attachment surface for receiving fasteners, such as screws, bolts, rivets, pins to secure the additional fence components to the post.

Preferably adapter 60 comprises at least on substantially flat surface 62, bordered by opposed lateral edges 62. Lateral edges 62 engage support member 40 within receiving channel 47 with a snug interference fit. More preferably, we have found that adding serrations 64 along lateral edges 62 assists in securing adapter 60 within receiving channel 47, by the serrations 64 impinging the support member 40 in apex 46. The length of adapter 60 may be extended to provide a longer surface area for receiving fasteners therein such as may be required for attachment of a gate hinge as opposed to a rail end.

Figure 5:
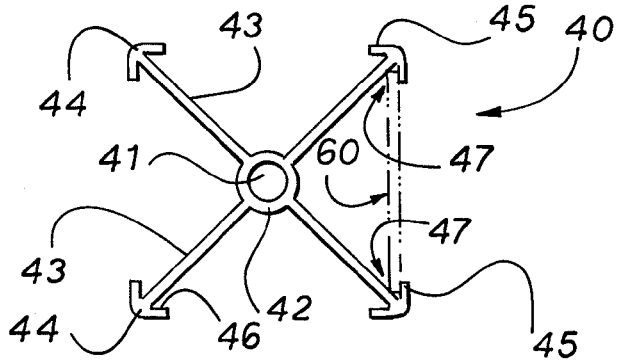
FIG. 5 depicts an end view of an alternative embodiment of a post support member.
Figure 6:
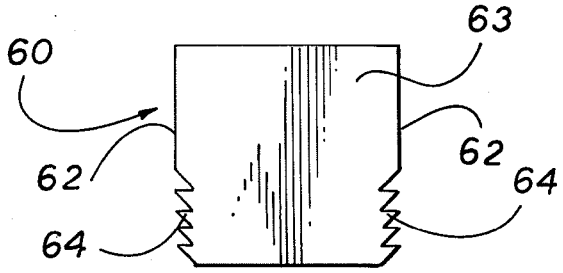
FIG. 6 depicts a mounting adapter plate.

To add greater versatility with respect to the orientation and placement of attachment points 61, flanges 45 should ideally be defined from the sides of each arm 43, such as the generally arrowhead shaped flanges 45 depicted in FIG. 5. In this preferred embodiment, each receiving channel 47 is oriented in a different direction and is capable of receiving an adapter 60 to permit secure attachment of additional fence components along any side of the post 10. Before tightening the fasteners 33 to secure the compression plate 35, support member 40 may be rotated relative attachment rod 30 to obtain the desired alignment.

While the embodiment shown indicates a generally square orientation of arms 43 and sleeve 50, other post shapes may be readily obtained by altering the length and angular displacement of the arms 43 and/or varying the number of arms 43 that extend from support column 42. The inner walls 52 of sleeve 50 would then be shaped to conform to the shape defined by the support member 40. By way of example, and not limiting the scope of the contemplated invention, three arms 43, could readily define a triangular post, five arms 43, a pentagonal post, and so on.

It should be understood that although examples of preferred embodiments of the invention have been disclosed herein in some detail, modifications and variations might be made without departing from the spirit and scope of the invention. Accordingly, all forms of the invention are claimed that come within the scope of the appended claims.

What is claimed is:

1. A post assembly comprising:

an attachment rod threaded at an upper end;

an elongate support member having a support column defining an inner bore receiving said attachment rod there through;

a plurality of arms extending longitudinally and outwardly from said support column with each arm of said plurality of arms having opposing flanges extending toward adjacent ones of said plurality of arms to define at least one receiving channel along a longitudinal length of said support member;

a vinyl outer sleeve surrounding said support member such that ends of said plurality of arms engage an inner wall of said sleeve;

an adapter having at least one flat surface bordered by opposed lateral edges, said opposed lateral edges inserted into said receiving channel with an interference fit;

a nut threadedly engaged on said upper end of said attachment rod; and at least one compression plate received on said attachment rod between said nut and said support member.

2. The post assembly of claim 1, wherein said adapter is a plate.

3. The post assembly of claim 1, wherein said lateral edges further comprise at least one serration.

4. A post assembly comprising an elongate support member and an outer sleeve;

the support member comprising an elongate support column having a bore defined through said support column to receive an attachment rod therethrough and a plurality of arms extending radially from said support column;

flanges extending from adjacent ones of said plurality of arms and defining a receiving channel; and at least one rectangular adapter dimensioned to be inserted into said receiving channel with an interference fit, wherein said support member is slidingly received in said sleeve such that ends of said plurality of arms engage an inner wall of said sleeve, said support column maintained in compression by engagement with said attachment rod extending there though.

5. The post assembly of claim 4, wherein an end of said attachment rod is threaded.

6. The post assembly of claim 5, further comprising a fastener to threadedly engage said end of said attachment rod.

7. The post assembly of claim 6, wherein a compression plate is inserted over said end of said attachment rod between said support member and said fastener.

8. A post assembly comprising:

an attachment rod having a top threaded end receiving a threaded nut and a bottom threaded end for engaging a support surface, an outer sleeve having a uniform cross-section;

an elongate support member having a support column defining an inner bore receiving said attachment rod there through and a plurality of arms extending radially and longitudinally along said support column wherein a free end of each arm of said plurality of arms is received in an inner corner of said outer sleeve, each free end having at least one flange, each of said flanges extending toward another of said flanges to define at least one pair of opposing flanges, each pair of opposing flanges defining a receiving channel there between, at least one rectangular plate adapter having opposed lateral edges inserted into said receiving channel with an interference fit, at least one compression plate received between said nut and said support member, said attachment rod extending through a center of the compression plate, whereby tightening said nut on said rod acts to compress said support member between said compression plate and said surface.

9. A post assembly comprising:

An attachment rod having a top threaded end receiving a threaded nut and a bottom threaded end for engaging a support surface;

A sleeve of square cross section;

An elongate support member having a substantially x-shaped cross section, the support member having a support column defining an inner bore receiving said attachment rod there through and four arms extending radially and longitudinally along said support column with a free end of each support column received in an inner corner of said sleeve, each free end having two flanges, each of said flanges extending toward another of said flanges to define four pairs of opposing flanges, each pair of opposing flanges defining a receiving channel there between;

At least one square plate adapter having opposed serrated lateral edges inserted into said receiving channel with an interference fit;

At least one compression plate received between said nut and said support member, the attachment rod extending through a center of the plate, Whereby tightening said nut on said rod acts to compress said support member between said compression plate and said surface.

* * * * *